US007678026B2

(12) United States Patent
Lewis

(10) Patent No.: US 7,678,026 B2
(45) Date of Patent: Mar. 16, 2010

(54) MOBILE PHYSICAL TRAINING SYSTEM AND METHOD THEREOF

(76) Inventor: Robert Lewis, 1320 Wellesley Pl., Riverdale, GA (US) 30296-2972

( * ) Notice: Subject to any disclaimer, the term of this patent is extended or adjusted under 35 U.S.C. 154(b) by 1182 days.

(21) Appl. No.: 10/851,591

(22) Filed: May 21, 2004

(65) Prior Publication Data

US 2005/0272572 A1 Dec. 8, 2005

(51) Int. Cl.
*A63B 71/00* (2006.01)

(52) U.S. Cl. ..... 482/74; 482/65; 482/68

(58) Field of Classification Search ..... 482/68, 482/74, 65; 280/87.5, 87.021, 87.04, 13, 280/14, 1.5, 22, 47.29; D/130, 128, 112
See application file for complete search history.

(56) References Cited

U.S. PATENT DOCUMENTS

| | | | | |
|---|---|---|---|---|
| 4,067,571 | A | | 1/1978 | Rogers |
| 4,334,677 | A | * | 6/1982 | Tata ..... 482/14 |
| 4,382,302 | A | | 5/1983 | Watson |
| 4,451,037 | A | | 5/1984 | O'Hare |
| 4,505,476 | A | | 3/1985 | Rubin |
| 4,527,794 | A | | 7/1985 | Dunn |
| 4,666,359 | A | | 5/1987 | Parr |
| 4,776,604 | A | | 10/1988 | Valdez et al. |
| 4,828,252 | A | | 5/1989 | Bowen et al. |
| 4,854,572 | A | | 8/1989 | Knight |
| 4,867,439 | A | | 9/1989 | Salyer |
| 4,961,573 | A | | 10/1990 | Wehrell |
| 5,013,039 | A | | 5/1991 | Cole |
| 5,070,816 | A | | 12/1991 | Wehrell |
| 5,137,272 | A | | 8/1992 | Wilkinson |
| 5,167,601 | A | | 12/1992 | Frappier |
| 5,197,931 | A | | 3/1993 | Wroclawsky |
| 5,217,186 | A | | 6/1993 | Stewart et al. |
| 5,277,436 | A | | 1/1994 | Frank et al. |
| 5,385,355 | A | * | 1/1995 | Hoffman ..... 280/1.5 |
| 5,417,635 | A | | 5/1995 | Sell |
| 5,419,570 | A | | 5/1995 | Bollotte |
| 5,427,390 | A | * | 6/1995 | Duncan et al. ..... 280/8 |
| 5,460,589 | A | | 10/1995 | Dunn |
| 5,472,394 | A | | 12/1995 | Michaelson |
| 5,490,826 | A | | 2/1996 | Rose |
| 5,511,802 | A | * | 4/1996 | Aitken ..... 280/1.5 |
| 5,529,556 | A | | 6/1996 | Segarra |
| 5,573,487 | A | | 11/1996 | Wallner |
| 5,586,957 | A | | 12/1996 | Wilkinson |
| 5,800,312 | A | | 9/1998 | Ormondroyd |

(Continued)

OTHER PUBLICATIONS

Perform Better, Inc., "Performance Better! The Guide To Functional Training and Rehabilitaiton", 2004, 60 pages.

*Primary Examiner*—Jerome W. Donnelly
(74) *Attorney, Agent, or Firm*—Innovative IP, LLC; Sandra M. Sovinski

(57) ABSTRACT

A mobile physical training system and method, wherein a wheeled platform is secured to a user via a bodyworn harness and/or belt, wherein the user can easily and selectively manipulate the amount of resistant weight carried by the platform, and wherein consistent, hands-free delivery the resistant weight force is realized for both pushing and pulling actions, thereby enabling the physical training system of the present invention to target speed, strength, and endurance training for individuals of virtually any skill level during a variety of training activities, such as walking, jogging, forward, backward and lateral running, push training, mobility training, and wheelchair training.

20 Claims, 7 Drawing Sheets

U.S. PATENT DOCUMENTS 5,803,881 A 9/1998 Miller
5,810,697 A 9/1998 Joiner
5,921,896 A 7/1999 Boland
5,950,570 A 9/1999 Dickerson
5,951,443 A 9/1999 Askins
5,971,891 A 10/1999 Humphrey
5,992,865 A 11/1999 Vargas
6,013,007 A * 1/2000 Root et al. ..... 482/8
6,036,609 A 3/2000 Gilman
6,086,517 A 7/2000 Schapmire
6,139,033 A * 10/2000 Western ..... 280/47.23
6,193,319 B1 2/2001 Kielinski
6,216,926 B1 4/2001 Pratt
6,328,325 B1 12/2001 Greenwood
D475,323 S * 6/2003 Hallgrimsson ..... D12/130
6,612,971 B1 * 9/2003 Morris ..... 482/74
2001/0038185 A1 11/2001 DeNoble et al.

* cited by examiner

MOBILE PHYSICAL TRAINING SYSTEM AND METHOD THEREOF

FIELD OF THE INVENTION

The present invention relates generally to physical training devices, and more particularly, to a mobile physical training system and method thereof, wherein a variety of training skills can be selectively emphasized and wherein resistance is user specified. The present invention is particularly suited for, although not limited to, use in physical training techniques such as over-speed training, speed training, strength training, endurance training, multi-directional running, push training, mobility training, and wheelchair training.

BACKGROUND OF THE INVENTION

It is well accepted that physical training can be beneficially enhanced through the use of resistance training devices. For example, some individuals have utilized weight vests to focus on speed, power and endurance training while walking or jogging. However, such vests can disadvantageously exert pressure on the wearer's lower back, knees and ankles and are frequently too heavy for the average person to utilize.

Running chutes are also used by some athletes, wherein the chute dimensions determine the resistant pulling forces exerted on the runner. Unfortunately, although running chutes can be good for speed and strength training, a user must be able to run at a certain speed in order to make use thereof. Thus, such devices are not helpful for many runners, walkers or joggers.

Unlike running chutes, harness worn sleds offer variable weight resistance, enabling use for speed, power and some endurance training. These sleds are designed to slide across flat grassy surfaces, but are not suitable for use on most pathways commonly utilized by walkers and joggers. Moreover, the use of a nylon cord for pulling such a sled introduces inconsistent force delivery and can be disadvantageously dangerous to the pulling individual on a downhill run.

Another type of resistant device offers a two-wheeled design for use on a larger variety of surfaces. However, known devices of this type that are adapted for cardiovascular workouts unfortunately rely upon complicated resistance mechanisms. Further, although some such devices include rods to enable pulling and pushing, the rods must be disadvantageously held within a user's hands, thereby limiting the natural range of movement and, by design, imparting a disadvantageous change in traction between the wheels and the ground when movement is initiated.

Therefore, it is readily apparent that there is a need for a mobile physical training system and method, wherein a wheeled platform is secured to a user via a bodyworn harness and/or belt, wherein the user can easily and selectively manipulate the amount of resistant weight carried by the platform, and wherein consistent delivery the resistant weight force is realized for both pushing and pulling actions, thereby enabling the physical training system of the present invention to target speed, strength, and endurance training for individuals of virtually any skill level during a variety of training activities, such as walking, jogging, forward, backward and lateral running, push training, mobility training, and wheelchair training, and thus avoiding the above-discussed disadvantages.

BRIEF SUMMARY OF THE INVENTION

Briefly described, in a preferred embodiment, the present invention overcomes the above-mentioned disadvantages and meets the recognized need for such a device by providing a mobile physical training system and method thereof, wherein variable weight resistance is user controlled and consistently delivered, and wherein a hands-free, secure support system enables a variety of training methods to be selectively employed.

According to its major aspects and broadly stated, in its preferred form, the present invention is a mobile physical training system and method, wherein a wheeled platform is secured to a user via a bodyworn harness and/or belt, wherein the user can easily and selectively manipulate the amount of resistant weight carried by the platform, and wherein consistent, hands-free delivery the resistant weight force is realized for both pushing and pulling actions, thereby enabling the physical training system of the present invention to target speed, strength, and endurance training for individuals of virtually any skill level during a variety of training activities, such as walking, jogging, forward, backward and lateral running, push training, mobility training, and wheelchair training.

More specifically, the device of the present invention in its preferred form is a wheeled physical training device, system and method, wherein a rolling platform supports removable weights. The platform has wheels to enable ease of motion over imperfect surfaces and is designed to limit and/or compensate for undesirable movement of the platform in response to pushing or pulling forces if received during use. The rolling platform is pushed or pulled via at least one rod, wherein the rod is secured between the rolling platform and the user's belt and/or harness, and/or the user's wheelchair, bicycle, or the like, and wherein the length and/or angle of the rod can be varied depending upon the user and/or mode of use. It is envisioned that the belt and/or harness can also include a heart rate/pulse monitor.

A feature and advantage of the present invention is the ability of such a system and method to deliver an essentially stead and consistent tension irrespective of whether the user walks, jogs or runs.

Another feature and advantage of the present invention is the ability of such a system and method to enable selection and delivery of a generally constant level of weight resistance.

Another feature and advantage of the present invention is the ability of such a system and method to enable hands-free resistant training.

Another feature and advantage of the present invention is the ability of such a system and method to enable resistance training without requiring complicated resistance mechanisms.

A feature and advantage of the present invention is the ability of such a system and method to enable cardiovascular weight training without exerting pressure on the lower back.

A feature and advantage of the present invention is the ability of such a system and method to triple the number of calories burned during a workout, relative to a typical speed walking workout.

A feature and advantage of the present invention is the ability of such a system and method to be utilized by virtually any individual of essentially any skill level for a variety of training activities, such as walking, jogging, forward, backward and lateral running, push training, mobility training, and wheelchair training.

These and other features and advantages of the invention will become more apparent to one skilled in the art from the following description and claims when read in light of the accompanying drawings.

BRIEF DESCRIPTION OF THE DRAWINGS

The present invention will be better understood by reading the Detailed Description of the Preferred and Alternate Embodiments with reference to the accompanying drawing figures, in which like reference numerals denote similar structure and refer to like elements throughout, and in which.

DETAILED DESCRIPTION OF THE PREFERRED AND ALTERNATE EMBODIMENTS

In describing the preferred and alternate embodiments of the present invention, as illustrated in the figures and/or described herein, specific terminology is employed for the sake of clarity. The invention, however, is not intended to be limited to the specific terminology so selected, and it is to be understood that each specific element includes all technical equivalents that operate in a similar manner to accomplish similar functions.

Figure 1:
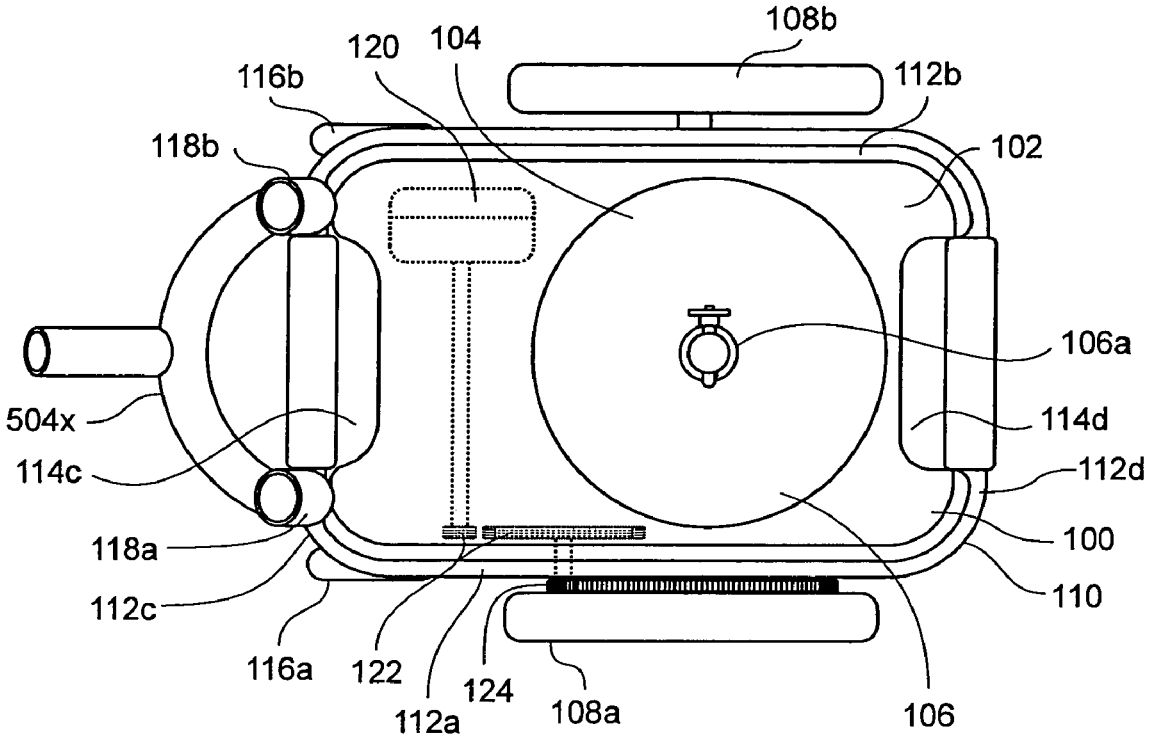
FIG. 1 is a top view of a wheeled platform, according to the preferred embodiment of the present invention.
Figure 2:
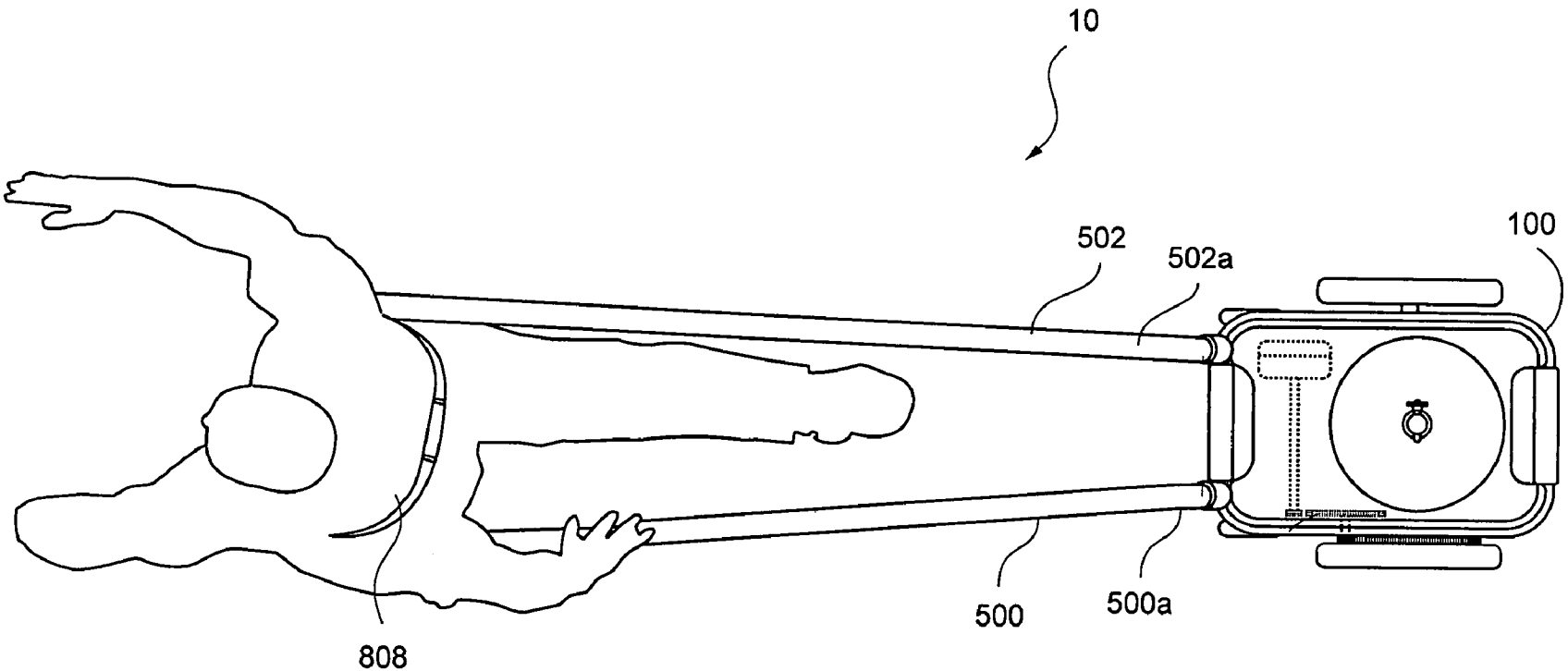
FIG. 2 is a top view of a mobile physical training system, according to the preferred embodiment of the present invention, showing a wheeled platform being pulled by a user.
Figure 3:
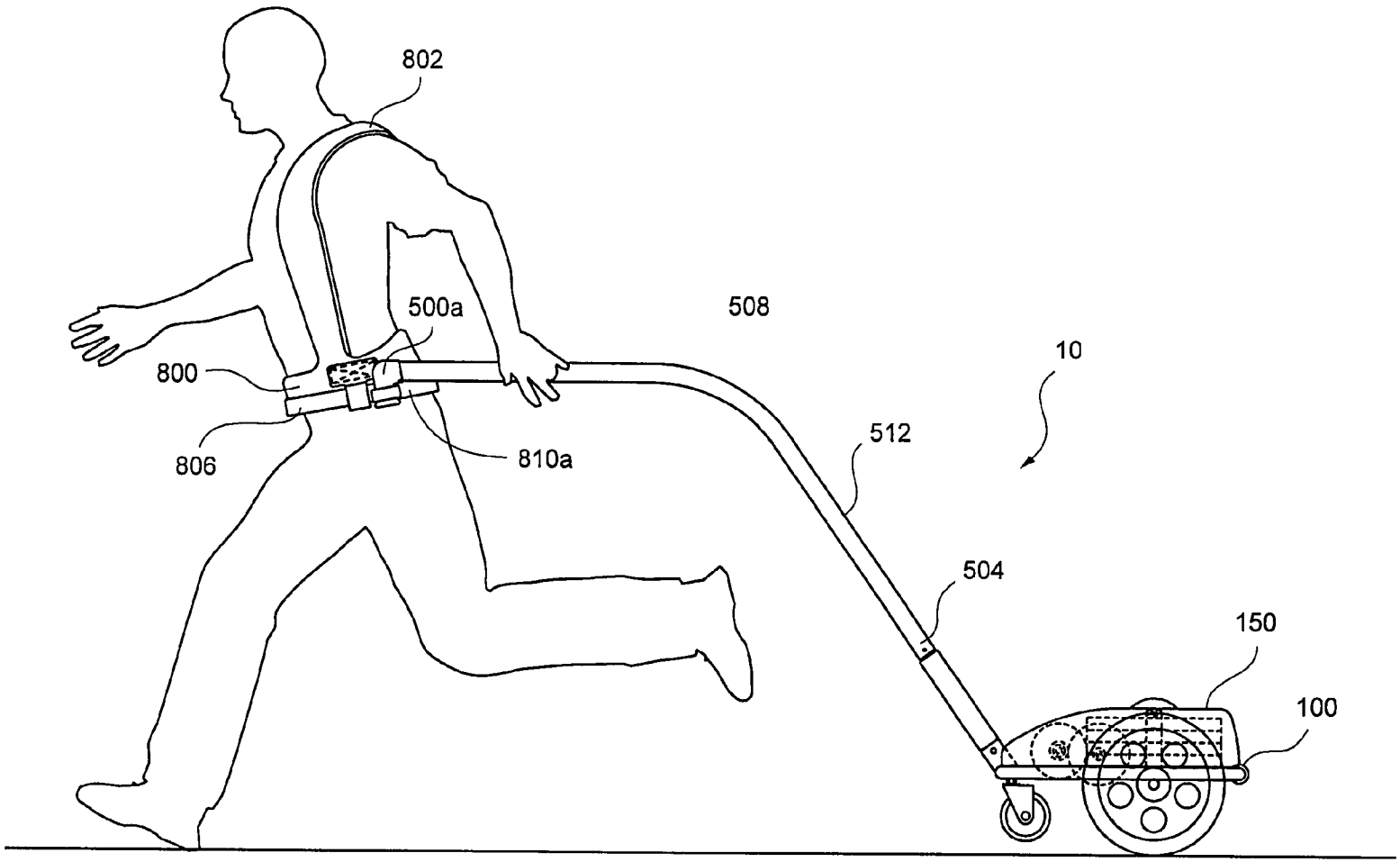
FIG. 3 is a side view of the mobile physical training system of FIG. 2.
Figure 4:
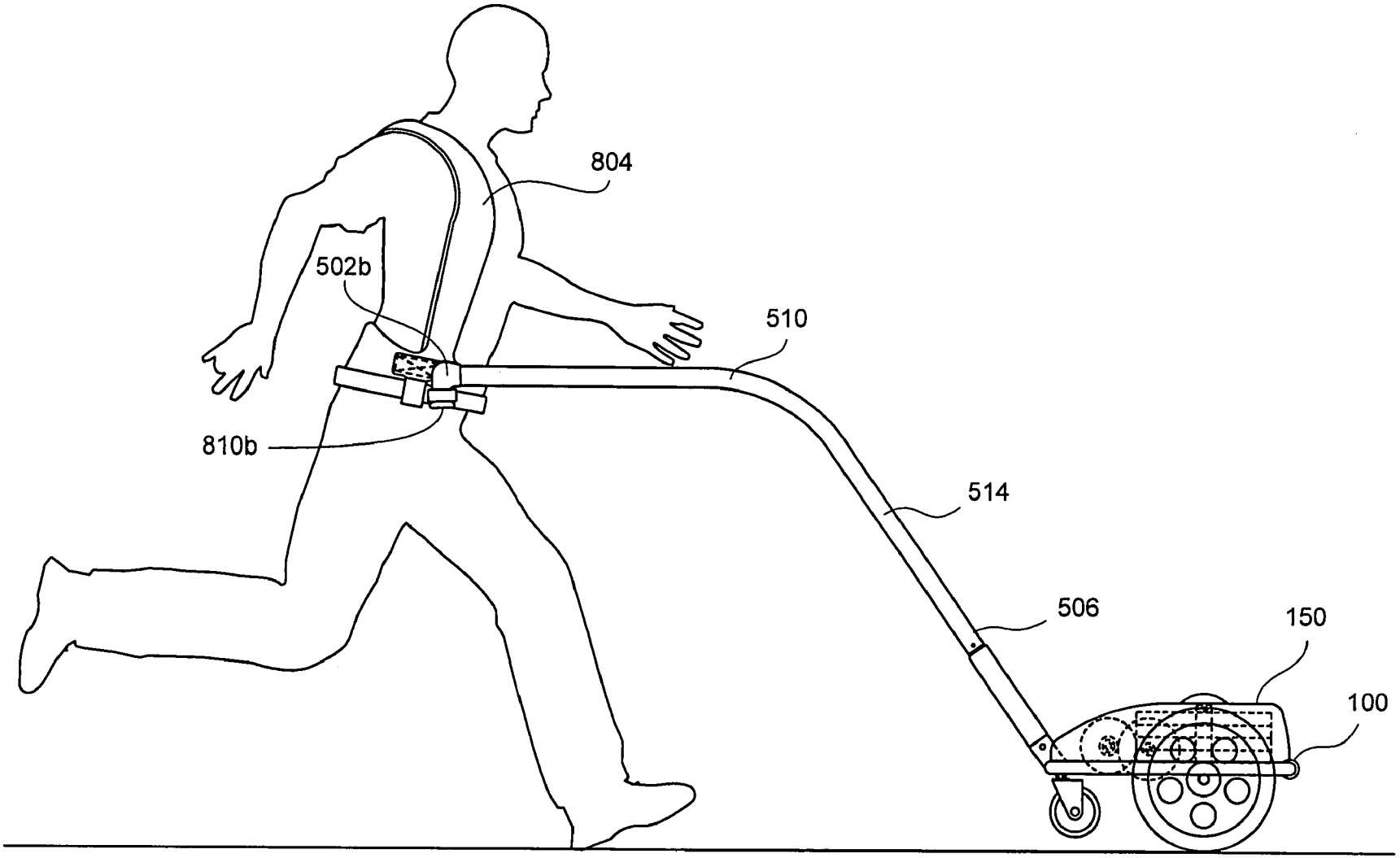
FIG. 4 is a side view of a mobile physical training system, according to the preferred embodiment of the present invention, showing a wheeled platform being pushed by a user.

Referring now to FIGS. 2-4, the present invention in the preferred embodiment is mobile physical training system 10 and method thereof, comprising rolling platform 100, support members 500 and 502, and harness 800. In the preferred embodiment, rolling platform 100, as detailed in FIG. 1, is generally rectangularly-shaped, preferably defined by supportive flooring surface 102. Preferably, flooring surface 102 is steel, however, one skilled in the art would readily recognize that other materials having sufficient supportive characteristics could be utilized such as, for exemplary purposes only, wood, wherein support member 104 preferably extends from flooring surface 102 enabling the secure placement of weight 106 thereon.

Support member 104 is preferably dimensioned for insertion into generally standardized central aperture 106*a* of weight 106, wherein support member 104 could be dimensioned to accommodate virtually any size aperture without departing from the intended scope of the present invention. Preferably, support member 104 is centrally positioned between first wheel 108*a* and second wheel 108*b*, and inside of frame 110, wherein frame 110 preferably defines a generally rectangular-shaped perimeter around flooring surface 102, said perimeter defined by first elongated side 112*a*, second elongated side 112*b*, front 112*c*, and rear 112*d*. In the preferred embodiment, cover 150 is provided for rolling platform 100, preferably hingedly related thereto, wherein weight 106 and any other components supported therein are essentially protected from weather conditions, and wherein storage of a plurality of components therein is possible during periods of non-use.

Preferably, frame 110 is tubular steel, wherein grip-enhancing material such as, for exemplary purposes only, foam rubber, is provided on front 112*c* and rear 112*d* of frame 110, and wherein hand-access apertures 114*c* and 114*d* are defined through flooring surface 102 proximate front 112*c* and rear 112*d*, respectively, of frame 110. In the preferred embodiment, first wheel 108*a* is positioned proximate first elongated side 112*a* and second wheel 108*b* is positioned proximate second elongated side 112*b*, wherein first wheel 108*a* and second wheel 108*b* are positioned preferably slightly off center, that is, closer to rear 112*d* of frame 110 than to front 112*c*. This preferred placement of first wheel 108*a* and second wheel 108*b* enables preferential weight distribution for rolling platform 100. Also preferred, first caster 116*a* and second caster 116*b* are provided proximate first elongated side 112*a* and second elongated side 112*b*, respectively, of frame 110 proximate to front 112*c*, wherein the dimensions of first and second casters 116*a* and 116*b*, respectively, are preferably such that neither consistently contacts the ground during use of mobile physical training system 10. First caster 116*a* and second caster 116*b* preferably function to receive pushing and/or pulling impact forces from support members 500 and 502 during use of mobile physical training system 10, wherein other type wheels could be alternately utilized, but the generally unrestricted rolling capabilities of first and second caster 116*a* and 116*b*, respectively, are preferred so that movement of rolling platform 100 is essentially non-effected if and when first and second caster 116*a* and 116*b* do contact the ground.

In the preferred embodiment, support brackets 118*a* and 118*b* are swivelably mounted to front 112*c* of frame 110, wherein first end 500*a* of support member 500 and first end 502*a* of support member 502 can be securely retained by support brackets 118*a* and 118*b*, respectively, as seen in FIG. 2. As described further hereinbelow, support brackets 118*a* and 118*b* are also dimensioned to receive forked support member/adaptor 504 for use of mobile physical training system 10 in a single support member capacity in lieu of a dual support member capacity.

Although mobile physical training system 10 is fully functional and capable of assisting in a wide variety of resistance training techniques via manipulation of weight 106, it is preferred that variable resistance mechanism 120 is provided as a complementary user-adjustable feature to enhance the range of resistance selection options, wherein variable resistance mechanism 120 can preferably be disengaged to engage in free-wheeling, weighted exercise. In the preferred embodiment, variable resistance mechanism 120 is a magnetic mechanism, as is known in the art, wherein gear reduction set 122 engages gear 124 of first wheel 108*a*, thereby influencing the freedom of rotation of first wheel 108*a* relative to the user-selected resistance.

Referring now to FIGS. 3 and 4, preferred harness 800 comprises first shoulder strap 802, second shoulder strap 804, belt 806, and lower back support 808. Although the style depicted in FIGS. 3 and 4 is preferred for harness 800, it should be readily recognized by one skilled in the art that the design of harness 800 is not intended to be limiting in any way and many other harness designs could accomplish the same function as is herein described. In the preferred embodiment, support brackets 810*a* and 810*b* are provided on belt 806, wherein support brackets 810*a* and 810*b* are dimensioned to receive and secure second end 500*b* of support member 500 and second end 502*b* of support member 502, respectively.

Support brackets 810*a* and 810*b* are preferably positioned proximate to the rear of the harness wearer, that is, slightly behind the central waistline, wherein during pulling, support members 500 and 502 extend behind the harness wearer, as depicted in FIG. 3. Conversely, during pushing, support members 500 and 502 extend in front of the harness wearer, as depicted in FIG. 4.

In the preferred embodiment, both support member 500 and support member 502 are utilized. However, as alternately described herein, mobile physical training system 10 can be utilized with forked support member 504. Preferably, support members 500 and 502 have two sections, wherein first sections 504 and 506, respectively, are proximate first ends 500*a* and 502*a*, and wherein second sections 508 and 510, respectively, are proximate second ends 500*b* and 502*b*, respectively. Preferably, first sections 504 and 506 and second sections 508 and 510 are connected via linking members 512 and 514, respectively. In the preferred embodiment, first sections 504 and 506 are generally straight, and second sections 508 and 510 are obtusely angled. Upon interconnection of first sections 504 and 506, linking members 512 and 514, and second sections 508 and 510, respectively, in the preferred configuration, an acute angle is defined between first sections 504 and 506 and the surface, wherein second sections 508 and 510, proximate second ends 500*b* and 502*b*, are generally parallel to the surface.

Figure 5:
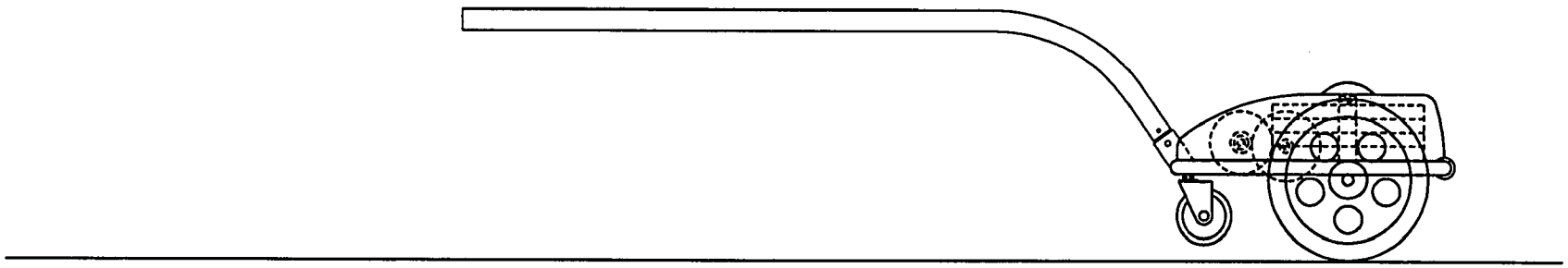
FIG. 5 is a perspective view of a mobile physical training system, according to an alternate embodiment of the present invention, showing a wheeled platform adapted for pulling by a racing wheelchair.

Referring now to FIG. 5, rolling platform 100 can alternately be utilized without harness 800, wherein first end 504*a* of forked support member 504 can be securely adapted to support brackets 118*a* and 118*b* of rolling platform 100 and second end 504*b* of forked support member 504 can be secured to a racing wheelchair. This alternate means of adaptation can also be utilized for a bicycle, or the like.

Figure 6:
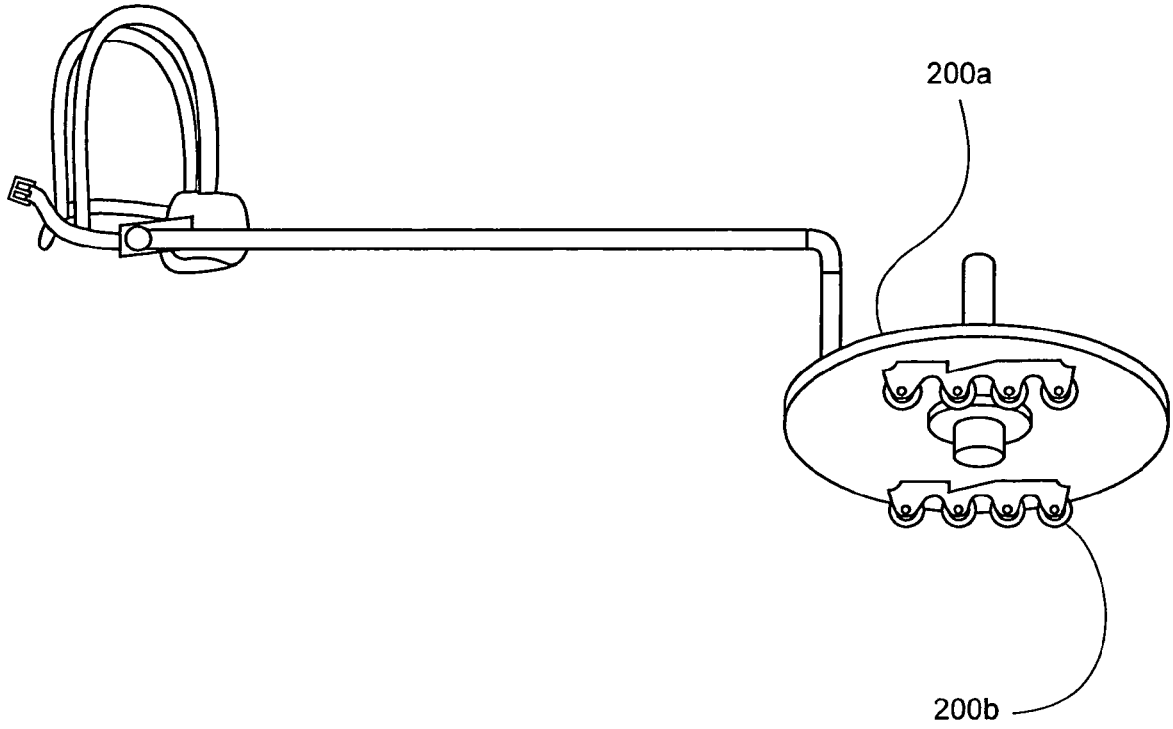
FIG. 6 is a perspective, bottom view of a mobile physical training system, according to an alternate embodiment of the present invention, showing an inline-wheel platform.

Referring now to FIG. 6, rolling platform 100 can be alternately configured with dual in-line wheels 200*a* and 200*b*. Further, platform 100 can be any shape, such as circular, as shown, square, or any other desired shape. Platform 100, with alternate in-line wheels 200*a* and 200*b*, is supported during use via alternate upward arm 600, positioned approximately 90° from alternate elongated support arm 602, wherein harness 800 could be utilized to secure and pull platform 100 during use of said alternate embodiment.

Figure 7:
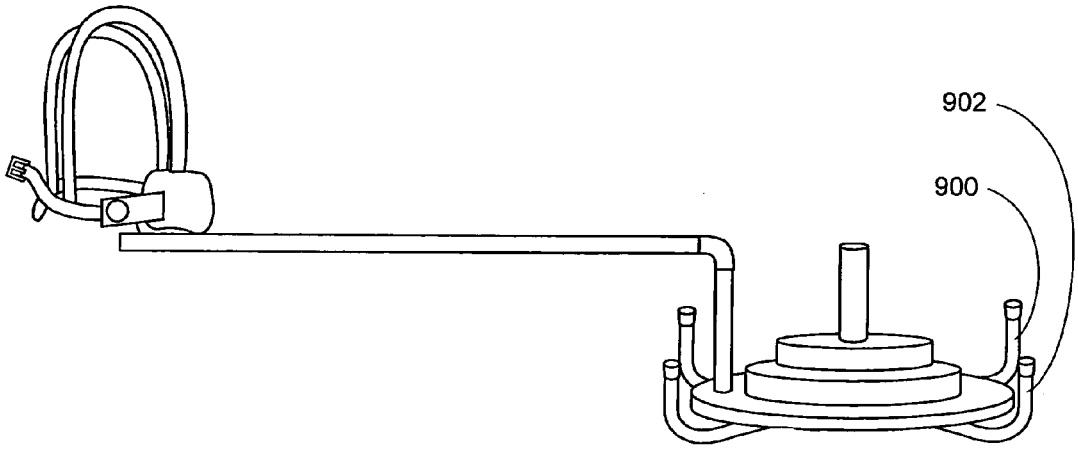
FIG. 7 is a perspective, side view of a mobile physical training system, according to an alternate embodiment of the present invention, showing a sled-type platform.

Referring now to FIG. 7, platform 100 can be alternately configured with generally X-shaped sled members 900 and 902, wherein passage over irregular, inclined, declined, grassy, and/or any other non-wheelable surfaces could be enabled.

In an alternate embodiment, the length of elongated support members 500 and 502 can be varied as desired, in order to enable preferential angle of use and/or any other relatively defined parameter for mobile physical training system 10.

In an alternate embodiment, the mobile physical training system 10 could be designed to be easily disassembled to enable portability.

In use, desired weight 106 is securely placed on mobile platform 102. A user can wear belt 806 or harness 800, which may include additional features such as heart monitor, or the like. As a user walks or runs, steady and consistent tension is provided with a constant level of weight resistance.

Machine/system 10 can have college logo on board/platform 102, rods 500, 502, belt 806 and/or harness 800.

In an alternate embodiment, the length and/or angle of rods 500, 502 can be varied depending upon the user and/or mode of use. It is envisioned that belt 806 and/or harness 800 can also include heart rate/pulse monitor (not shown).

In an alternate embodiment, machine/system 10 can include an insulated compartment or cooler for receiving water or other hydrating beverages for consumption during and/or after a training session, wherein a plug and/or drain can be included to facilitate drainage of melted ice or other fluid.

In an alternate embodiment, elongated support members 500 and 502 can be broken down and/or telescopically reduced to enable storage under cover 150, wherein wheels 108*a* and 108*b* could bend and/or fold inward, also for storage. Hooks could be provided to support a carrying strap, whereupon following storage of components under cover 150, machine/system 10 could be easily transported.

In an alternate embodiment, handheld poles could be provided to assist with user movement and/or balance if machine/system 10 is utilized on stairs or other inclined training setup.

In another alternate embodiment, machine/system 10 could be configured to hold water and/or sand and/or other weighted material in lieu of and/or in addition to traditional weighted plates.

In another alternate embodiment, belt 806 could be configured with a rear central support in addition to and/or in lieu of side supports, wherein a single rod support could be enabled thereby.

In another alternate embodiment, machine/system 10 could be configured with only one caster, or without casters.

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims.

I claim:

1. A mobile physical training system, comprising:

a ground-traversing platform having a generally flat upper surface and a support member carried by and extending at a right angle from said upper surface, said platform adapted for supporting and carrying one or more weights in a generally horizontal orientation relative to the ground;

one or more stackable weights, wherein each said one or more stackable weights has a central aperture defined therethrough, and wherein said central aperture is dimensioned to receive said support member therethrough, whereby each said one or more stackable weights is removably carried by said platform and positionally secured on said platform by said support means;

a bodyworn support; and at least one elongated support member, a first end of said at least one elongated support member carried by said platform and a second end of said at least one elongated support member carried by said bodyworn support, wherein pulling forces delivered to said at least one elongated support member from said bodyworn support pull said ground-traversing platform with said one or more stackable weights supported thereon across the ground, and wherein pushing forces delivered to said at least one elongated support member from said bodyworn support push said ground-traversing platform with said one or more stackable weights support thereon across the ground.

2. The mobile physical training system of claim 1, wherein said bodyworn support is a harness.

3. The mobile physical training system of claim 1, wherein said bodyworn support is a belt.

4. The mobile physical training system of claim 1, wherein said at least one elongated support member is two elongated support members, with each carried proximate an opposing side edge of said ground-traversing platform.

5. The mobile physical training system of claim 1, wherein said at least one elongated support member is length-adjustable.

6. The mobile physical training system of claim 1, wherein said ground-traversing platform carries wheels.

7. The mobile physical training system of claim 1, wherein said bodyworn support carries body function monitoring equipment.

8. The mobile physical training system of claim 1, wherein said elongated support member comprises a plurality of related members.

9. The mobile physical training system of claim 8, wherein said plurality of related members includes an angled member.

10. The mobile physical training system of claim 1, wherein said ground-traversing member further comprises a cover.

11. The mobile physical training system of claim 1, wherein said ground-traversing platform comprises a generally tubular frame, said frame carrying grip-enhancing material.

12. The mobile physical training system of claim 6, wherein said wheels comprise two axially related wheels and at least one caster.

13. The mobile physical training system of claim 11, wherein said frame further comprises a plurality of swivelably carried support brackets.

14. The mobile physical training system of claim 13, further comprising a forked support member configured to receive said at least one elongated support member.

15. The mobile physical training system of claim 6, further comprising a variable resistance mechanism.

16. The mobile physical training system of claim 15, wherein said variable resistance mechanism is a magnetic mechanism.

17. The mobile physical training system of claim 2, wherein said harness comprises a first shoulder strap, a second shoulder strap, a waist belt, and a lower back support member.

18. The mobile physical training system of claim 17, wherein said harness further comprises a plurality of support brackets dimensioned to receive and secure said first end of said at least one elongated support member.

19. The mobile physical training system of claim 1, wherein said ground-traversing platform further comprises an insulated compartment.

20. The mobile physical training system of claim 10, wherein said at least one elongated support member is adapted to enable storage under said cover.

* * * * *